US005566806A

United States Patent [19]

Reale

[11] Patent Number: 5,566,806

[45] Date of Patent: Oct. 22, 1996

[54] VENDING MACHINE FOR TENNIS BALL CONTAINERS

[76] Inventor: David L. Reale, 15 January Walk, Long Beach, N.Y. 11561

[21] Appl. No.: 317,713

[22] Filed: Oct. 4, 1994

[51] Int. Cl.[6] ..... G07F 11/34

[52] U.S. Cl. ..... 194/215; 221/129; 221/281

[58] Field of Search ..... 221/129, 281, 221/295, 298, 301; 194/206, 207, 215

[56] References Cited

U.S. PATENT DOCUMENTS

| | | | |
|---|---|---|---|
| 3,348,733 | 10/1967 | Johnson | 221/298 |
| 3,397,763 | 8/1968 | Wahlberg | 194/206 |
| 3,467,275 | 9/1969 | Vaughan et al. | 221/295 X |
| 5,176,288 | 1/1993 | Craven | 221/124 |
| 5,199,598 | 4/1993 | Sampson | 221/194 |
| 5,259,530 | 11/1993 | Ishine et al. | 221/68 |
| 5,310,035 | 5/1994 | Dobransky | 194/206 |
| 5,397,025 | 3/1995 | Lee | 221/298 X |

FOREIGN PATENT DOCUMENTS

| | | | |
|---|---|---|---|
| 1-302496 | 12/1989 | Japan | 221/129 |

*Primary Examiner*—F. J. Bartuska
*Attorney, Agent, or Firm*—Michael I. Kroll

[57] ABSTRACT

A vending machine for tennis ball containers comprising a cabinet having a delivery station. A plurality of storage chutes are within the cabinet. Each chute holds a series of one particular brand of tennis ball containers. A facility in the cabinet is for accepting currency to cover the cost of one of the particular brand of tennis ball containers. An assembly in the cabinet is for selecting one of the particular brand of tennis ball containers. A unit is for dispensing one at a time, one of the particular brand of tennis ball containers selected into the delivery station of the cabinet.

1 Claim, 3 Drawing Sheets

VENDING MACHINE FOR TENNIS BALL CONTAINERS

BACKGROUND OF THE INVENTION

1. Field of the Invention

The instant invention relates generally to dispensing device and more specifically it relates to a vending machine for tennis ball containers.

2. Description of the Prior Art

Numerous dispensing device have been provided in prior art. For example, Craven U.S. Pat. Nos. 5,176,288; Sampson 5,199,598; Ishine et al. 5,259,530 and Dobransky, Jr. et al. 5,310,035 all are illustrative of such prior art.

While these units may be suitable for the particular purpose to which they address, they would not be as suitable for the purposes of the present invention as heretofore described.

CRAVEN, HERMAN

CONTROL DISPENSING APPARATUS FOR VENDING MACHINES

U.S. Pat. No. 5,176,288

A novel control storing and dispensing apparatus for a vending machine, or the like is provided. The apparatus is particularly adapted for storing and dispensing cylindrical products of various types and sizes in single and multiple depth stack fashion. The dispensing mechanism for each section includes at least one motor-driven auger mounted in an almost horizontal position in relation to cylindrical products rolling down a shallow slope to control storing, feeding and dispensing of the cylindrical products from the bottom of a stack for each selection, as the mechanism is cycled. The apparatus can also be used to dispense cylindrical products of a relatively wide range of diameters by using spacers or movable ramps to position products properly to fit into the auger track. The apparatus also can dispense a product longer than conventional cans, such as certain bottled beverages, by using several augers. By coupling a second auger to a first powered auger and timing the dispense mechanism of two adjacent columns, products form the two columns can be dispensed simultaneously or alternately.

SAMPSON, TYREE

DISPENSING APPARATUS FOR TENNIS BALL CONTAINERS

U.S. Pat. No. 5,199,598

An apparatus for dispensing tennis balls is provided having a hopper for storing tennis ball containers, a serpentine track, and a dispensing device for releasing tennis ball containers form the serpentine track. A housing of moderate size supports the various components of the apparatus, and preferably includes a money operated actuator to actuate the dispensing device, and a dispensing bin in a removable front housing panel. The apparatus may be mounted on a stand and used as a free standing unit, or placed on a counter.

ISHINE, SEIZO TAGO, MASATO FUJIOKA, KIYOSHI

AUTOMATIC VENDING MACHINE

U.S. Pat. No. 5,259,530

An automatic vending machine for automatically vending commodities comprises at least one storage unit for storing the commodities. At least two discharge paths are downwardly branched from the storage unit, for discharging the commodities. A feed unit is for opening and closing the two discharge paths alternately for feeding the commodities one by one from the storage unit.

DOBRANSKY, JR., BERNARD J. STOKEN, RAYMOND G.

PAPER AND COIN CURRENCY TOTALIZER FOR AN EXISTING VENDING MACHINE

U.S. Pat. No. 5,310,035

An improved paper and coin currency totalizer is installed on an existing vending machine, that utilizes the existing coin receiving channels, the existing movable mechanical release mechanism and the reset mechanism. An electronic coin sensor is installed in alignment with the coin receiving channel to produce a coin signal. A box is mounted on the vending machine and includes a paper currency sensor to produce a paper signal. A totalizer control circuit in the box accepts the coin signals and paper signals to determine when the proper amount of currency has been deposited to activate an actuation mechanism installed in the machine to move the release mechanism to the release position to allow a selection. After a selection is made, a reset sensor installed in the machine, in alignment with the reset mechanism, sends a reset signal to the totalizer control circuit to discontinue the actuation mechanism and to indicate no currency has been deposited. A method is provided to convert the mechanical totalizer in an existing vending machine to include the improved paper and coin currency totalizer.

SUMMARY OF THE INVENTION

A primary object of the present invention is to provide a vending machine for tennis ball containers that will overcome the shortcomings of the prior art devices.

Another object is to provide a vending machine for tennis ball containers that will discharge a selected brand of new tennis balls in a container therefrom, when a proper amount of money is inserted for the cost of the container.

An additional object is to provide a vending machine for tennis ball containers that will be conveniently located at a tennis court site, so that a tennis player can purchase a container of tennis balls therefrom during any time of the day.

A further object is to provide a vending machine for tennis ball containers that is simple and easy to use.

A still further object is to provide a vending machine for tennis ball containers that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
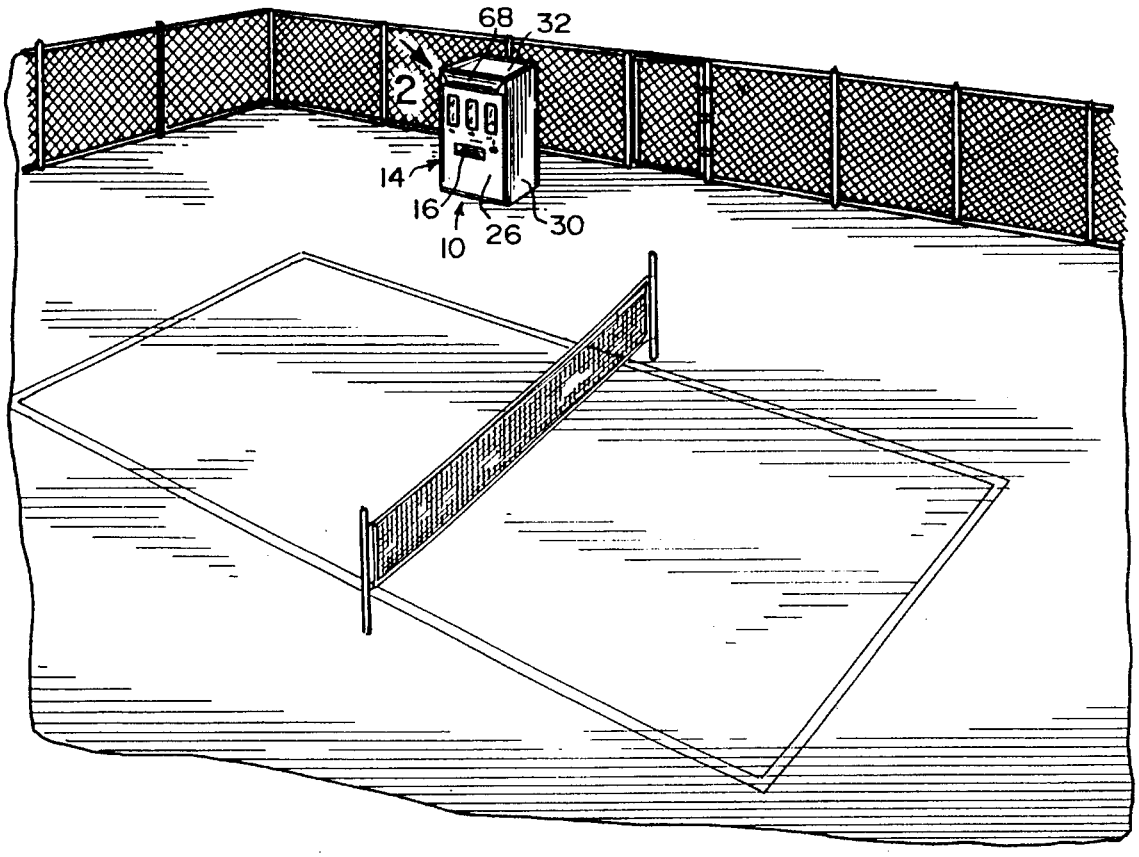
FIG. 1 is a perspective view of the instant invention located at a tennis court site.
Figure 2:
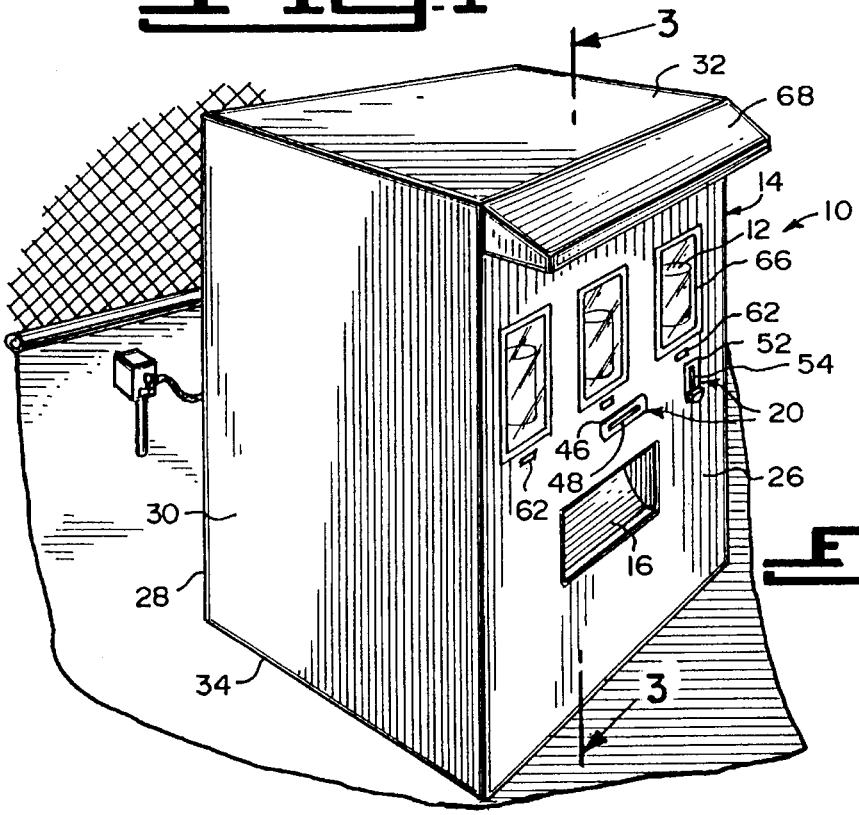
FIG. 2 is an enlarged perspective view of the instant invention taken in the direction of arrow 2 in FIG. 1.
Figure 3:
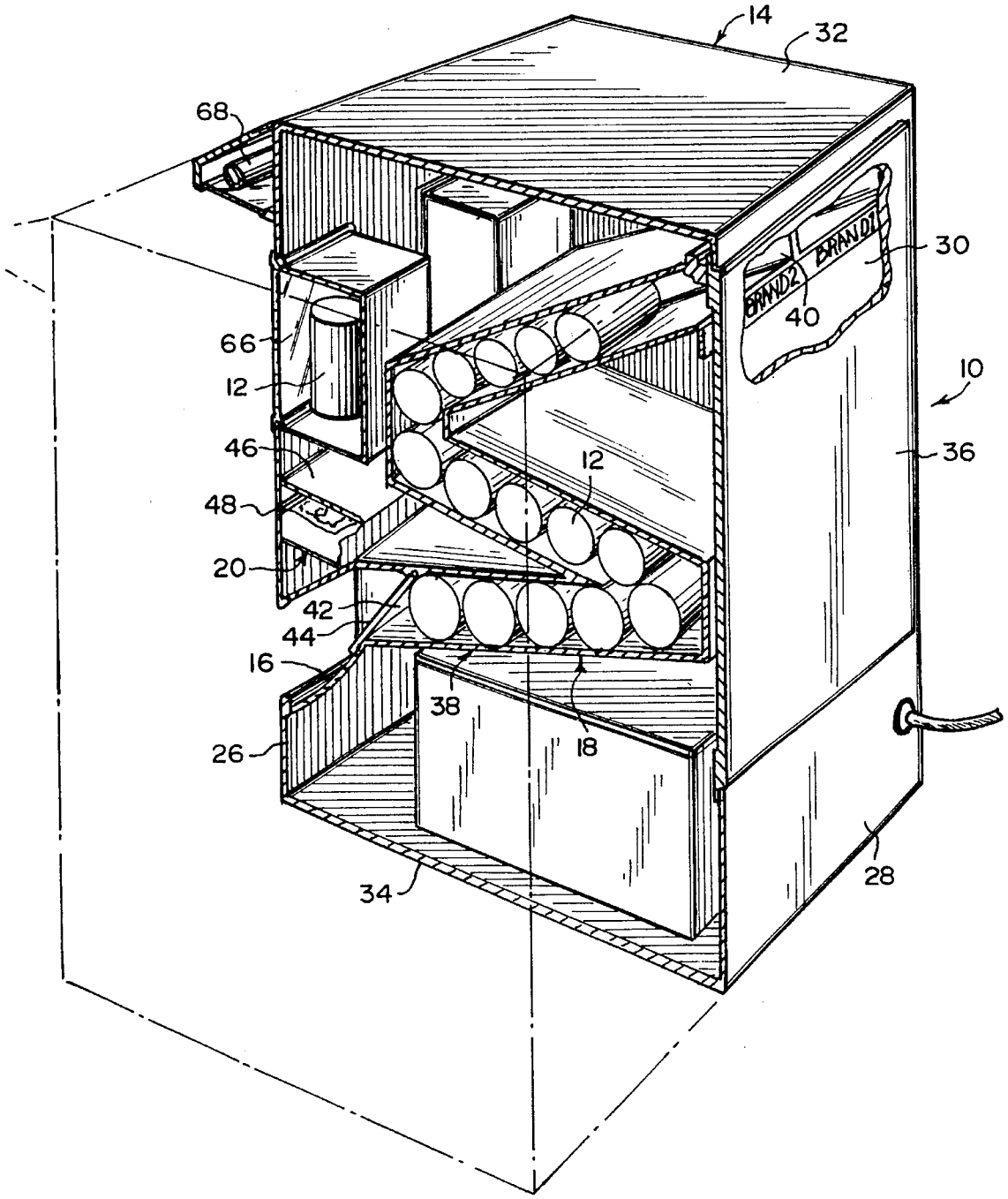
FIG. 3 is a further enlarged cross sectional perspective view taken along line 3—3 in FIG. 2.

Turning now descriptively to the drawings, in which similar reference characters denote similar elements throughout the several views, FIGS. 1 through 3 illustrate a vending machine 10 for tennis ball containers 12, comprising a cabinet 14 having a delivery station 16. A plurality of storage chutes 18 are within the cabinet 14. Each chute 18 holds a series of one particular brand of tennis ball containers 12. A facility 20 in the cabinet 14, is for accepting currency to cover the cost of one of the particular brand of tennis ball containers 12. An assembly 22 in the cabinet 14 is for selecting one of the particular brand of tennis ball containers 12. A unit 24 is for dispensing one at a time, one of the particular brand of tennis ball containers 12 selected into the delivery station 16 of the cabinet 14.

The cabinet 14 is box-shaped and includes a front wall 26 with the delivery station 16 built therein, a rear wall 20, a pair of side walls 30, a top wall 32 and a bottom wall 34 are also provided. A removable access panel 36 is in the rear wall 28.

Each storage chute 18 is a serpentine channel track 38, having an upper inlet port 40 and a lower outlet port 42. The upper inlet port 40 located behind the access pane 36 in the rear wall 28 of the cabinet 14, will receive the particular brand of tennis ball containers 12. The lower outlet port 42 will be in communication with the delivery station 16 in the front wall 26 of the cabinet 14.

Each storage chute 18 contains a hinged door 44 located at the lower outlet port 42 of the serpentine channel track 38. When the door 44 is opened, it will allow one of the particular brand of tennis ball containers 12 selected to drop into the delivery station 16 in the front wall 26 of the cabinet 14.

The currency accepting facility 20 comprises a bill receptacle 46 having a slot 48. The bill receptacle 46 is located in the front wall 26 of the cabinet 14, so that the slot 48 can receive bills deposited therein. A bill return mechanism 50 is coupled to the bill receptacle 46 in the front wall 26 of the cabinet 14, so as to eject an improper amount of bills deposited into the slot 48 in the bill receptacle 46.

The currency accepting facility 20 further contains a coin receptacle 52, having a slot 54. The coin receptacle 52 is located in the front wall 26 of the cabinet 14, so that the slot 54 can receive coins deposited therein. A coin return mechanism 56 is coupled to the coin receptacle 52 in the front wall 26 of the cabinet 14, so as to eject an improper amount of coins deposited into the slot 54 in the coin receptacle 52.

Figure 2A:
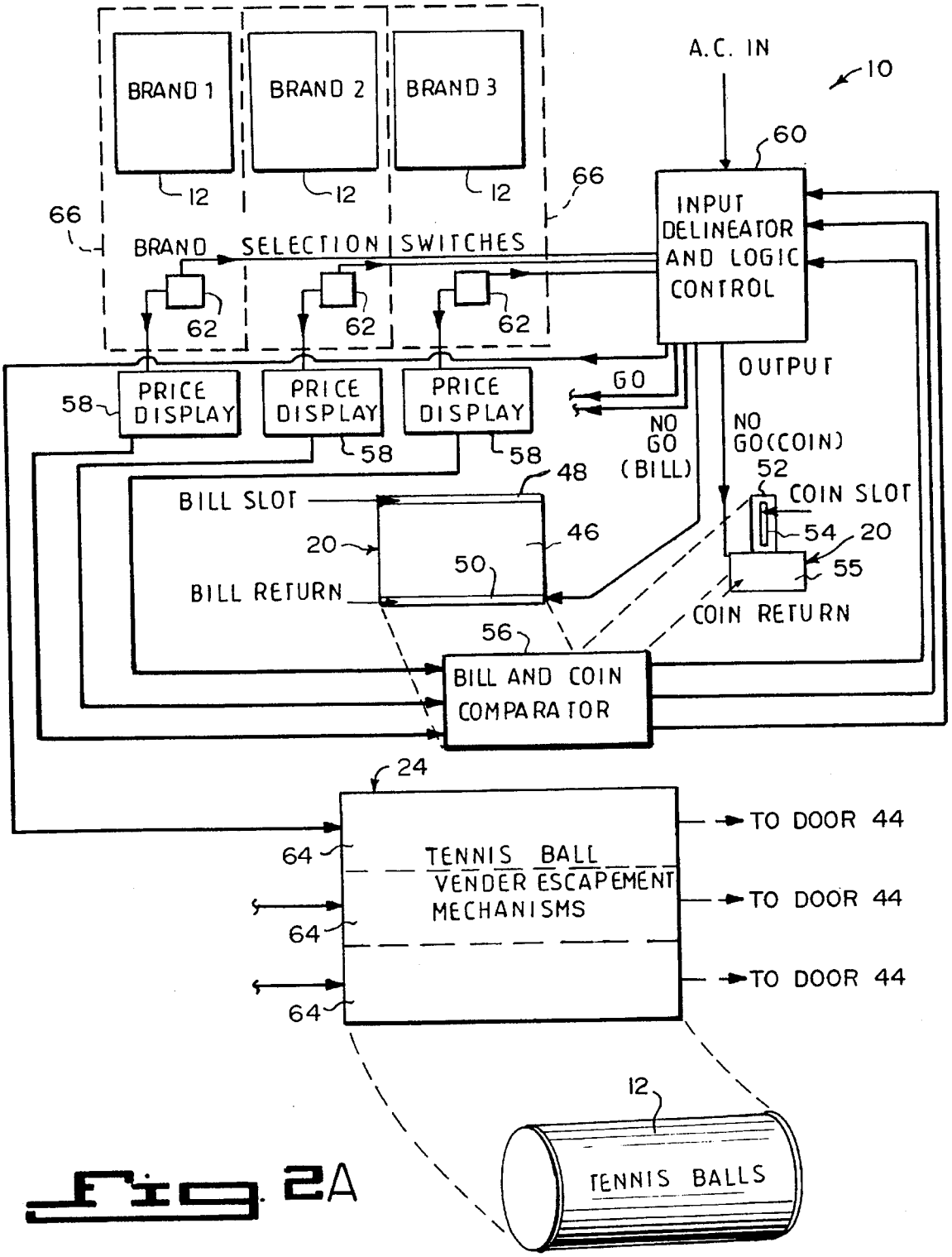
FIG. 2A is a block diagram of the internal circuitry of the instant invention.

The selecting assembly 22, shown in FIG. 2A, consists of a bill and coin comparator 56 aligned between the bill receptacle 46 and the coin receptacle 52. The bill and coin comparator 56 will determine if a proper amount of currency is deposited.

A plurality of price displays 58 are also provided. Each price display 58 is electrically connected in series to the bill and coin comparator 56. Each price display 58 will determine the amount of currency needed to purchase the particular brand of tennis ball container 12.

An input delineator and logic control 60 is electrically connected to the bill return mechanism 50 and the coin return mechanism 56. The bill and coin comparator 56 is electrically connected in series to the input delineator and logic control 60.

A plurality of brand selection switches 62 are electrically connected in series to the price displays 58 and the input delineator and logic control 60. The dispensing unit 24, as shown in FIG. 2A, includes a plurality of tennis ball vender escapement mechanisms 64. The input delineator and logic control 60 is electrically connected in series to each of the tennis ball vender escapement mechanisms 64. Each tennis ball vender escapement mechanism 64 is mechanically connected to one hinged door 44.

A plurality of display windows 66 are in the front wall 26 of the cabinet 14 above the brand selection switches 62. Each display window 66 can maintain one particular brand of tennis ball container 12 to be dispensed therefrom, when one brand selection switch 62 is manually depressed.

A lamp assembly 68 is mounted to an upper edge of the front wall 26 of the cabinet 14. The lamp assembly 68 can illuminate the front wall 26 of the cabinet 14 at night.

LIST OF REFERENCE NUMBERS

10 vending machine
12 tennis ball container
14 cabinet
16 delivery station on 14
18 storage chute in 14
20 currency accepting facility in 14
22 selecting assembly in 14
24 dispensing unit in 14
26 front wall of 14
28 rear wall of 14
30 side wall of 14
32 top wall of 14
34 bottom wall of 14
36 removable access panel in 28
38 serpentine channel track
40 upper inlet port on 38
42 lower outlet port on 38
44 hinged door
46 bill receptacle
48 slot in 46
50 bill return mechanism
52 coin receptacle
54 slot in 52
56 bill and coin comparator
58 price display
60 input delineator and logic control

62 brand selection switch

64 tennis ball vender escapement mechanism

66 display window in 26

68 lamp assembly on 26

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A vending machine for tennis ball containers comprising:

a) a box-shaped cabinet having a front wall with a delivery station built therein, a pair of side walls, a top wall, a rear wall, and a removable access panel in said rear wall;

b) a plurality of storage chutes within said cabinet, each said chute holding a series of one particular brand of tennis ball containers, and wherein each said storage chute is a serpentine channel track having an upper inlet port and a lower outlet port in which the upper inlet port, located behind said access panel in said rear wall of said cabinet, will receive the particular brand of tennis ball containers, while the lower outlet port will be in communication with the delivery station in said front wall of said cabinet, and a hinged door located at the lower outlet port of each said serpentine channel track;

c) means in said cabinet for accepting currency to cover the cost of one of the particular brand of tennis ball containers, said currency accepting means including a bill receptacle having a slot, said bill receptacle located in said front wall of said cabinet so that the slot can receive bills deposited therein, bill return means coupled to said bill receptacle in said front wall of said cabinet to eject bills deposited into the slot in said bill receptacle, coin receptacle means having a slot located in said front wall of said cabinet to receive coins deposited therein and coin return means coupled to said coin receptacle means to eject coins;

d) means in said cabinet for selecting one of the particular brand of tennis ball containers, said selecting means including switch means for selecting the tennis ball brand, bill and comparator means aligned between said bill receptacle means and said coin receptacle means to determine if a proper amount of money has been deposited, a plurality of price displays electrically connected to said comparator means to determine the amount of money needed to purchase the particular brand of tennis ball container selected, and input delineator and logic control means;

e) means for dispensing one at a time, one of the particular brand of tennis ball containers selected, into the delivery station of said cabinet, said dispensing means including a plurality of tennis ball vender escapement mechanisms, each escapement mechanism mechanically connected to one said hinged door;

f) a plurality of display windows in said front wall of said cabinet above said brand selection switch means wherein each display window maintains one particular brand of tennis ball container to be dispensed therefrom when one said brand selection switch is manually depressed; and g) lamp assembly means mounted on an upper edge of said front wall of said cabinet to illuminate said front wall of said cabinet at night.

* * * * *